US009528263B2

(12) United States Patent
Lightfoot

(10) Patent No.: US 9,528,263 B2
(45) Date of Patent: Dec. 27, 2016

(54) SELF-ALIGNING INTERLOCKING CONSTRUCTION BLOCKS

(71) Applicant: Thomas K Lightfoot, Houma, LA (US)

(72) Inventor: Thomas K Lightfoot, Houma, LA (US)

( * ) Notice: Subject to any disclaimer, the term of this patent is extended or adjusted under 35 U.S.C. 154(b) by 0 days.

(21) Appl. No.: 14/931,762

(22) Filed: Nov. 3, 2015

(65) Prior Publication Data

US 2016/0123004 A1 May 5, 2016

Related U.S. Application Data

(60) Provisional application No. 62/074,419, filed on Nov. 3, 2014.

(51) Int. Cl.

| | |
|---|---|
| ***E04B 1/00*** | (2006.01) |
| ***E04B 2/10*** | (2006.01) |
| ***E04C 1/00*** | (2006.01) |
| ***E04B 2/02*** | (2006.01) |

(52) U.S. Cl.

CPC . *E04B 2/10* (2013.01); *E04B 2/02* (2013.01); *E04C 1/00* (2013.01); *E04B 2002/0245* (2013.01); *E04B 2002/0247* (2013.01); *E04B 2002/0252* (2013.01)

(58) Field of Classification Search

CPC ..... E04B 2/10; E04B 2/02; E04B 2002/0245; E04B 2002/0252; E04B 2002/0247; E04C 1/00

USPC ..... 52/286, 293.2, 295, 503, 505

See application file for complete search history.

(56) References Cited

U.S. PATENT DOCUMENTS

| | | | | | |
|---|---|---|---|---|---|
| 923,975 | A | | 6/1909 | Johnston | |
| 3,292,331 | A | * | 12/1966 | Sams | E04B 2/10 52/300 |
| 3,368,317 | A | | 2/1968 | Meigs | |
| 3,864,885 | A | | 2/1975 | Muse | |
| 3,936,987 | A | | 2/1976 | Calvin | |
| 4,614,071 | A | * | 9/1986 | Sams | E04C 1/41 52/309.12 |
| 4,782,640 | A | * | 11/1988 | Scheiwiller | E01F 8/023 52/591.1 |
| 5,241,795 | A | * | 9/1993 | Giroux | E04C 1/40 106/15.05 |
| 5,901,520 | A | | 5/1999 | Abdul-Baki | |
| 5,930,958 | A | * | 8/1999 | Stanley | E04B 2/18 52/284 |
| 6,189,282 | B1 | | 2/2001 | VanderWerf | |

* cited by examiner

*Primary Examiner* — Basil Katcheves

(57) ABSTRACT

A self-aligning block system is disclosed having a series of block formations wherein the blocks comprise predefined polygonal shaped channels for insertion of a uniformly shaped polygonal peg. Insertion of a peg between adjacent channels will drive uneven blocks into alignment and hold the blocks without the need of mortar. Walls may be created by end-to-end stacking of linear blocks and half blocks in staggered or parallel columns to create internal walls and corners within a wall by addition of corner blocks and half blocks without offsetting the progression of the outer wall. Addition of half blocks into wall progression may be implemented to reset the progression of inner and outer walls after corner formation.

10 Claims, 11 Drawing Sheets

SELF-ALIGNING INTERLOCKING CONSTRUCTION BLOCKS

PRIORITY

This application claims priority to U.S. provisional application Ser. No. 62/074,419, filed on Nov. 3, 2014 entitled "Self-Aligning Interlocking Construction Blocks", the entire content of which is incorporated herein by reference.

FIELD OF THE INVENTION

The herein disclosed invention pertains to interlocking construction blocks which may be arranged as desired to form a structure. More specifically, the invention pertains to a series of self-aligning block arranged to form straight or angled wall structures. Terminal and central channels in each construction block form a uniform channel shape for correspondence with a similarly uniform shaped peg which will guide the channels and therefore the construction blocks into alignment.

BACKGROUND

Concrete construction blocks are advantageous in construction of walls for their ease of manufacture and construction, reduced material cost, durability, and insulating properties. Without proper alignment and reinforcement, a wall constructed from concrete construction blocks will lose stability, allow leaks, and be more prone to structural failure and associated negative outcomes that present risks to the safety of individuals and property.

To provide a stable hold between concrete blocks, mortar or grout is typically applied between the gaps of each block to set the blocks in place and prevent shifting. Use of mortar or grout presents a number of disadvantages. If the blocks have been placed incorrectly or the structure or wall formed is uneven or skewed by poor block placement, the entire structure or must be broken down and the spent materials discarded or cleaned before reformation of the structure or wall is reattempted. Further, heavy equipment and machinery used or maneuvered during construction operations, which is common during building projects, may cause vibration or settlement of the structure or wall foundation which can cause wall blocks to shift out of proper alignment. This problem is more common when the vibration or settlement occurs before the mortar or grout dries to set the construction blocks in place. Such disadvantages are costly as the create delays in construction, upsets in construction schedules, and often requires the spent building materials to be discarded and replaced.

A considerable amount of time is taken by construction crews to carefully arrange and properly set construction blocks in place. In many cases a considerable amount of calculation and measurement must be undertaken to ensure the finished structure is accurately constructed. Thus, it should be apparent that the foremost problem concerning construction of structures and walls with concrete construction blocks is ensuring proper alignment of the construction blocks during construction of a wall or other structure.

Another problem of wall construction with concrete blocks is construction of walls adjoining corner or perpendicular walls. Generally, an outer wall is created by stacking blocks end-to-end in stacked rows above each other with mortar applied between each end-to-end block and each ascending row of blocks. A corner or adjoining wall may be created, depending upon whether the blocks have been stacked in parallel columns or staggered rows, by arranging blocks perpendicular to the axis of the outer wall, applying mortar, and stacking each block along the new wall. In general, the formation of a perpendicular wall depends upon the arrangement of the outer wall blocks.

There is a disadvantage in laying of blocks of adjacent perpendicular walls in parallel columns because a flush internal wall surface is created between the adjacent walls. In order to create an adjacent perpendicular wall in such a situation, mortar must be either applied directly upon the outer wall itself to affix new perpendicular blocks to the outer wall or the new projecting wall must be formed at a column interrupting the progression of the outer wall. With either method, forming walls at a ninety-degree angle (90°) in such a situation is considerably difficult. Differences in applied mortar thickness can deflect the desired angle sufficiently to cause imperfections or cracks at the surface of the adjoin walls that may require the new perpendicular wall to be repaired or even deconstructed after the defect has been discovered. Such a problem is not only costly in time but in cost of supplies and man hours.

Forming walls by laying blocks in staggered rows, by extending each successive block partially beyond the end of the blocks above and below allows blocks to be stacked perpendicularly within a wall and allows the blocks to project outward from the outer wall creating a starting point for placing staggered blocks for creating of a perpendicular internal wall. However placing a perpendicular block within the outer wall creates a break in the staggered sequence of the outer wall blocks, making it difficult to form corners at the end of a section of the outer wall.

Another disadvantage typical concrete blocks used in wall construction is in the placement of reinforcement rods or rebar to reinforce the wall sections. Generally, rebar is placed within the inner cells of construction blocks to maintain the structural integrity of the wall while allowing the air pockets created by such cells to remain for expansion and contraction due to changes in external temperature. In such cases cement or grout must be placed within the cells of the blocks along with the rebar in order to hold the rebar and effect such structural reinforcement. If the bond between the cement or grout and the rebar or the bond between the cement or grout of the inner walls of the block cells should fail, the section of rebar used will become useless for reinforcement.

Yet another disadvantage of present concrete block wall constructions is the lack of stability when such a wall is subjected to sustained or frequent gusts of winds such as gale winds or hurricane winds which exceed sixty-four knots or one-hundred eighteen kilometers per hour (seventy-four miles per hour). Concrete walls, being fabricated of concrete blocks, create solid wall surfaces with no passages for channeling of wind through the wall. Such walls typically are constructed by placement of mortar between each brick often lack stabilizing factors sufficient to withstand the perpendicular forces exerted upon them by gale or hurricane force winds. When such walls are exposed to such high winds, the flat walls must deflect inward to absorb the wind forces, which may cause the wall to crack or crumble damaging the wall structure and presenting risk of injury and damage to persons and damage property within.

In light of such disadvantages, there is presently a need for a construction block which will align itself as the wall is constructed and which will allow perpendicular or internal walls to be formed without an offsetting corner formation. A need also exists for an expedient means of reinforcing a wall to reduce the incidence of structural failure without the need of slowing or stopping work.

SUMMARY OF THE INVENTION

The present invention is directed to a series of self-aligning construction blocks which provide an expedient means of reinforced wall formation. Generally, the self-aligning construction blocks comprise rectangular linear blocks, corner blocks, and half blocks formed of any suitable material. However, these blocks will typically be formed of cast or aerated concrete.

The linear blocks and corner blocks comprise two elongate side ends and two shorter terminal ends. Each linear block is formed with an internal channel having a polygon shape such an hourglass shaped channel and a terminal polygon shaped channel such as a trapezoidal shaped channel. The terminal channel when placed into horizontal opposing abutment with an adjoining terminal channel of an adjacent block form a polygon shaped slot in the same configuration as that of the internal polygon shaped channel.

Each corner block is formed with at least one lateral polygon channel and at least one terminal polygon shaped channel. The lateral and terminal polygon shaped channels of the corner blocks provide a means for creation of corners, internal walls, and wall junctions which can be fixed within the linear progression of an outer or inner wall for additional stability.

The half blocks are cubic in shape and are provided for use in conjunction with the rectangular linear and corner blocks. The cubic half block comprise two to four polygonal shaped channels and maintain proper block advancement in wall construction. After creation of a wall junction or corner, the half blocks may be inserted into the wall progression to reset the pacing of block placement.

An elongated polygonal shaped peg such as an hourglass shaped peg is further provided for a solid fit within the polygonal shaped channels and polygonal shaped slots formed by the terminal lateral channels of each block. The specially shaped polygonal shaped peg will allow easy alignment and connection with adjacent blocks to one another by facilitating the driving of each block into alignment to one another. The elongated shape of the peg is capable of feeding through multiple polygonal shaped channels and slots of blocks placed vertically adjacent to one another in order to affix the vertically stacked blocks in alignment to one another and prevent the shifting of the blocks during wall construction.

In the event that the blocks are placed out of horizontal alignment to each other for wall progression, the polygonal shaped channels and slots of the blocks provide a means to slidably drive the misaligned blocks into linear alignment to each other by the insertion of a peg through the horizontally adjacent polygonal shaped channels to interact with the slanted faces of the polygonal shaped channels. Similarly, in the event that vertically stacked adjacent blocks are placed out of alignment to a vertically adjacent row of blocks or the progression of a row of blocks begins to shift out of alignment, the misaligned blocks may be aligned by insertion of the peg through the vertically adjacent polygonal shaped channels and slots which will drive and hold the vertically stacked blocks in alignment.

Each terminal, lateral, and polygonal shaped channels of the construction blocks are oriented at a sufficient desired distance between the terminal corners of each block to provide a uniform and flush alignment when coupled to adjacent construction blocks. Hollow cells and sleeves running through the self-aligning blocks may be provided for creation of air pockets for compensation of wall expansion and contraction due to changes in temperature and for passage of length of rebar for wall enforcement. The polygonal shaped channels of the blocks and polygonal shaped peg may be formed to create cavities of desired sizes, such as hourglass shaped channels and slots. The cavities may be sized to create an optional air pocket within the blocks and the cavities may cooperate with the elongated shapes of the cells and sleeves to allow for rebar passage and the pouring of concrete to fill the sleeves, hollow cells, and cavities spaces to create a pillar therein for further reinforcement against high velocity winds.

These and other objects, advantages, and features of this invention will be apparent to those skilled in the art from a consideration of this specification, including the claims and drawings herein.

DESCRIPTION OF THE INVENTION

Figure 1:
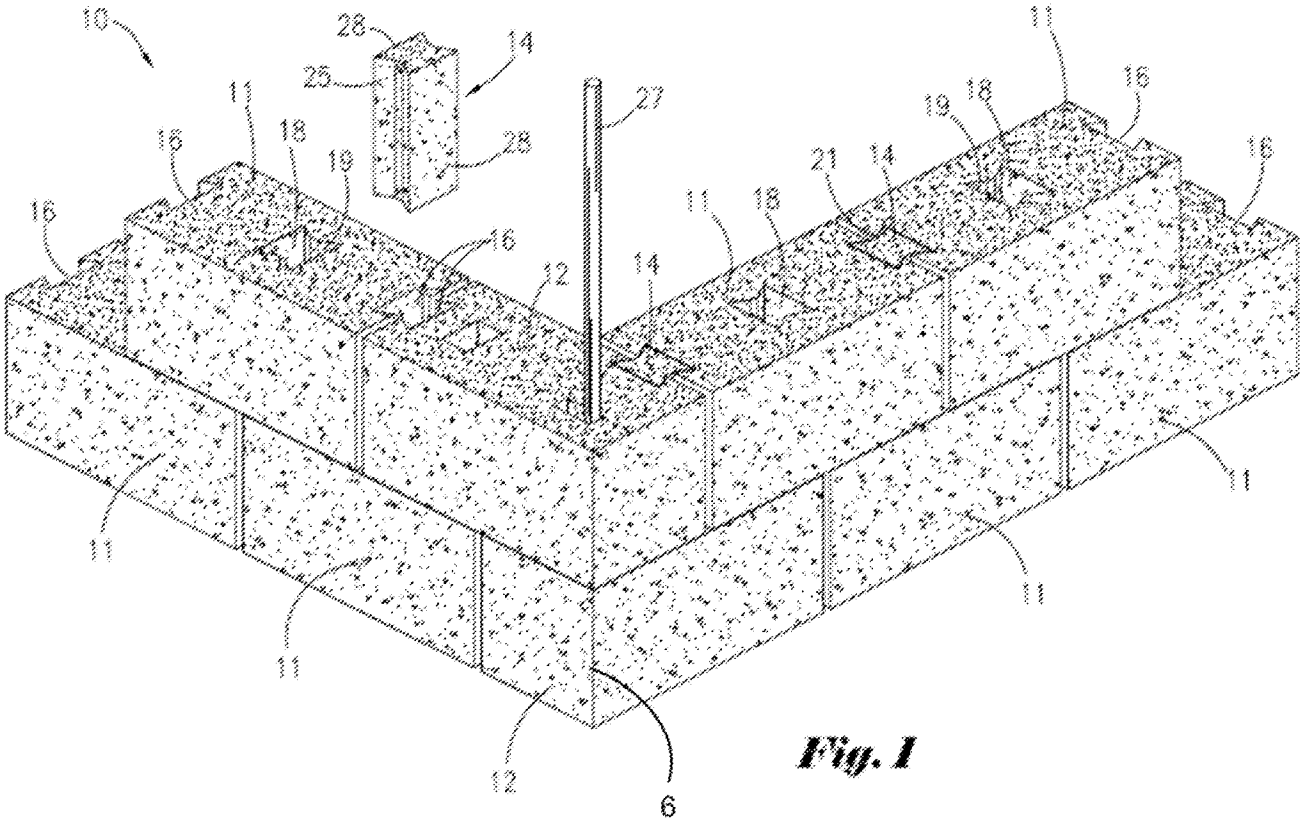
FIG. 1 is an isometric view of a wall corner constructed by the assembly of a series interlocking construction blocks of the present invention.

Referring now to the drawings and, more particularly to FIG. 1, there is shown an isometric view of the assembly of a series of self-aligning interconnecting construction blocks 10 embodying linear blocks 11, corner blocks 12, and half blocks 13. Pegs 14 are provided for sliding engagement within polygonal shaped channels shown as trapezoidal shaped channels 16, 17 provided through blocks 10. More specifically, the blocks 10 may be either rectangular, as embodied in linear blocks 11, corner blocks 12, junction blocks 12*a*, or T-junction blocks 12*b* or 12*c*, having terminal ends 1 and elongated sides 2, or cubical blocks, as embodied in linear half blocks 13, T-junction half blocks 13*a*, junction half blocks 13*b*, or corner half blocks 13*c*, having four terminal sides 1 one-half the length of elongated sides 2 of rectangular linear blocks 11, corner blocks 12, junction blocks 12*a*, or T-junction blocks 12*b* or 12*c*.

Each block 10 is defined by polygonal shaped channels, shown as trapezoidal shaped channels 16, 17, which are fashioned of overhanging edges 22 wherein inwardly formed outwardly slanting faces 23 project inward to create channels 16, 17. The meeting of adjacent channels 16, 17, wherein the overhanging edges 22 of the adjacent blocks 10 abut one another, form a wedge shaped inward projection similar to projection 20 of channel 18 which defines the abutting polygonal shaped slot, shown as hourglass shaped slot 21.

Figure 2:
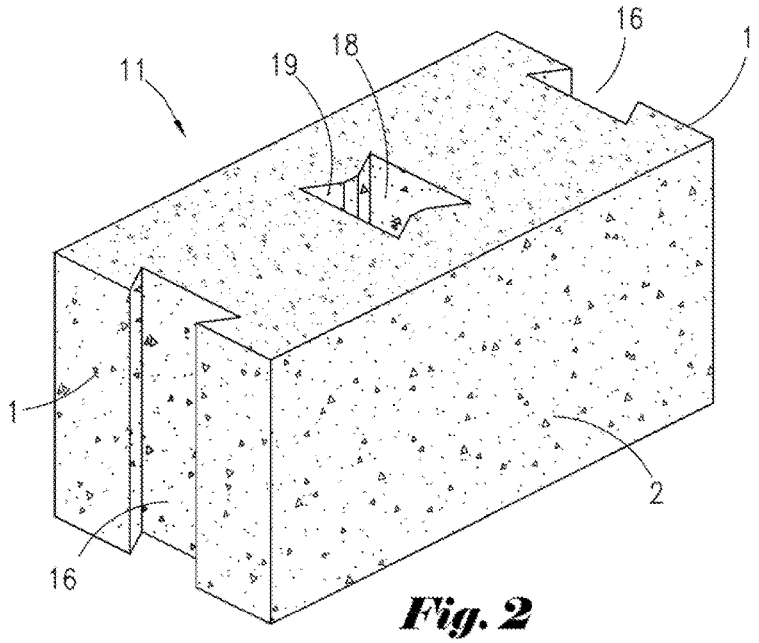
FIG. 2 is an isometric view of an embodiment of the linear block of the interlocking construction block assembly of the present invention.
Figure 3:
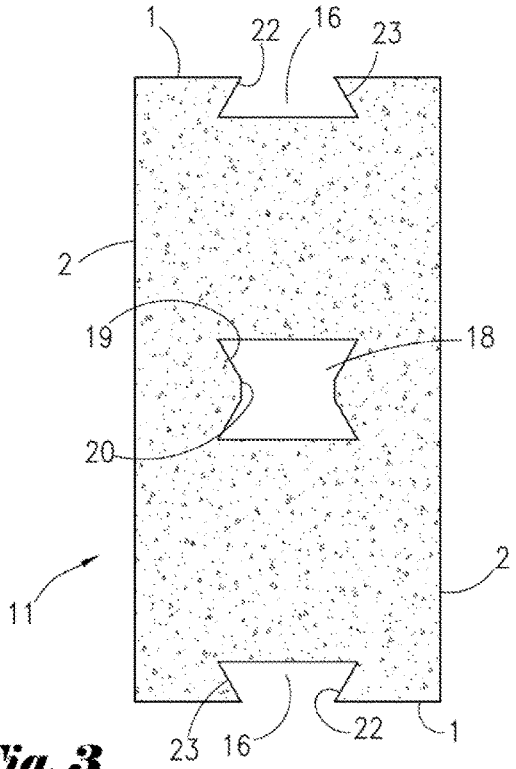
FIG. 3 is a top view of the linear block shown in FIG. 2.

As best seen in FIGS. 2 & 3, linear blocks 11 comprises terminal ends 1 and elongated sides 2 with a terminal channel 16 positioned upon each terminal end 1 of block 11 and an internal centrally located polygonal shaped channel shown as hourglass shaped channel 18. Terminal channels 16 are centrally located upon terminal ends 1 in order to provide for uniform alignment between horizontally and vertically adjacent blocks 10 when peg 14 is inserted therethrough. Channel 18 is positioned centrally within the length of linear block 11 an equal distance between terminal channels 16 and elongate sides 2 of linear block 11 in order to provide for uniform alignment between vertically adjacent blocks 10 when peg 14 is inserted therethrough. The shape of channel 18 is defined by wedge shaped inward projections 20 formed of intersecting inward slanted faces 19.

Terminal channels 16 and channel 18 traverse through terminal ends 1 and the center of linear block 11, respectively, along the same plane as to allow passages to be created between horizontally and vertically adjacent blocks 10 and create a flush external surface for wall formation. Terminal channels 16 when placed near the terminal channel 16 of another block 10 on the same horizontal row creates a slot 21 to allow for passage of the peg 14 to slidingly engage with faces 23 of channel 16 to affix linear block 11 in place and cause self-alignment with the horizontally adjacent blocks 10. Similarly, the channel 18 of linear block 11 when placed adjacent to the channel 18 or the slot 21 of a vertically adjacent blocks 10 allows for the passage of peg 14 through each channel 18 and slot 21 vertically aligned relative to each other to affix linear block 11 in place and cause self-alignment with the vertically adjacent blocks 10.

Figure 4:
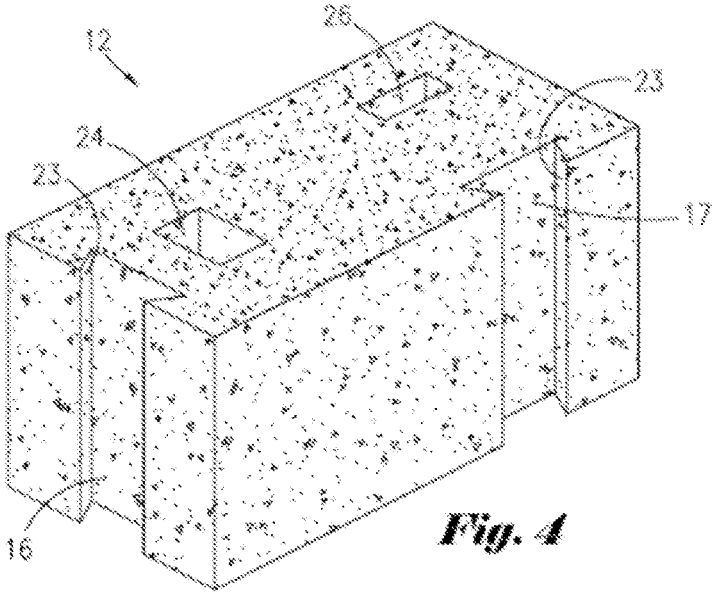
FIG. 4 is an isometric view of an embodiment of the corner block of the interlocking construction block assembly of the present invention.
Figure 5:
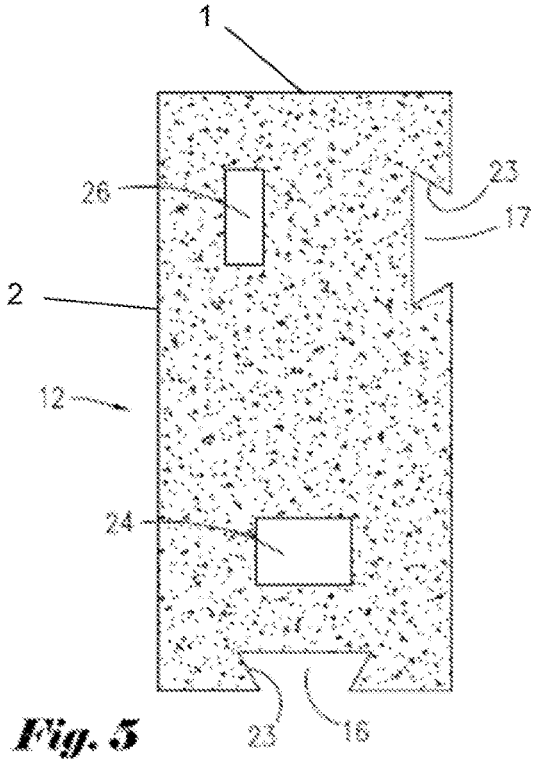
FIG. 5 is a top view of the corner block shown in FIG. 4.

Now referring to FIGS. 4 & 5, corner block 12 is similarly composed to linear block 11 with terminal ends 1 and elongate sides 2 but differs in containing a single terminal channel 16 on a terminal end 1, a single lateral channel 17 positioned off center on elongate side 2 proximate to the opposing terminal end 1, a hollow cell 24 implemented for reduction of weight in block 12 as well as for creation of an air pocket within the block for compensation of block expansion and contraction due to temperature changes, and an extended sleeve 26 for creation of a passage for a length of rebar 27. Corner block 12, with terminal channel 16 and lateral channel 17, is designed to provide a means of forming a flush outer corner 6 by alignment with the linear progression of a wall formed by linear blocks 11.

Terminal channel 16 of corner block 12 is centrally located upon terminal end 1 in order to provide for uniform alignment between horizontally and vertically adjacent blocks 10. Lateral channel 17 is positioned off-center a sufficient distance upon elongate side 2 so as to allow channels 16 of horizontally adjacent blocks 10 to abut and form slot 21 for alignment and affixing with the passage of peg 14 therethrough and to create a flush outer corner 6.

Extended sleeve 26 is formed in a narrow elongate shape in order to facilitate positioning, insertion, and passing of a section of rebar 27 there through. The narrow nature of extended sleeve 26 allows for the passage of rebar 27 through sleeve 26 as well as vertically adjacent channels 18, slots 21, hollow cells 24, and sleeves 26 which may be partially out of alignment with sleeve 26. The combination of the narrow elongate space of sleeve 26 leaves a passage narrow enough to create a fixed space within the vertically adjacent channels 18, slots 21, hollow cells 24, and sleeves 26, wherein in the event rebar 27 becomes dislodged from its grouting within sleeve 26, it will be pinned within the narrow space of sleeve 26 and the spaces created by the vertically adjacent channels 18, slots 21, hollow cells 24, and sleeves 26. Further a section of rebar may additionally be passed through channels 16 and 18 of vertically adjacent blocks 10.

Terminal channels 16, traversing terminal end 1, lateral channels 17, traversing elongate side 2, and hollow cell 24 and extended sleeve 26, traversing the central region of block 12, traverse through block 12 along the same plane as to allow passages to be created between horizontally and vertically adjacent blocks 10. Terminal channels 16 and lateral channels 17 when placed near the terminal channel 16 of another block 10 on the same horizontal row creates slot 21 to allow for passage of the peg 14 to affix and cause self-alignment between corner block 12 and an adjacent block 10. Insertion of peg 14 into slots 21 formed by the intersection of either the terminal channels 16 of corner block and a linear block 11 or the lateral channel 17 with the terminal channel 16 of a linear block 11, as desired to create corner 6, will maintain the formation of corner 6 in place even when exposed to vibration or shifting of the ground by nearby movement.

Figure 6:
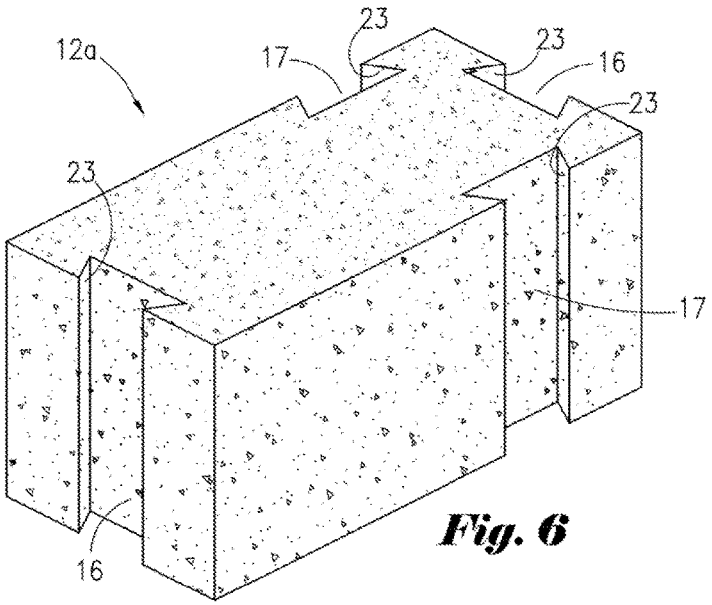
FIG. 6 is an isometric view of an alternate embodiment of a corner block configured as a junction block of the interlocking construction block assembly of the present invention.
Figure 7:
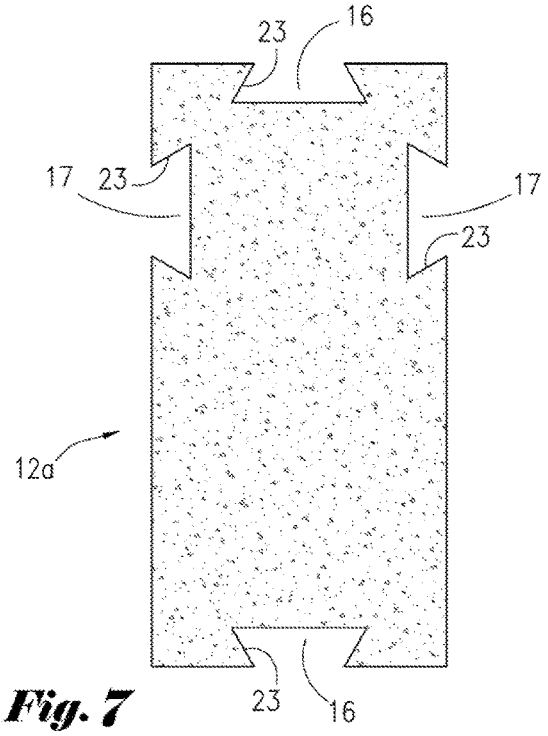
FIG. 7 is a top view of the junction block shown in FIG. 6.
Figure 8:
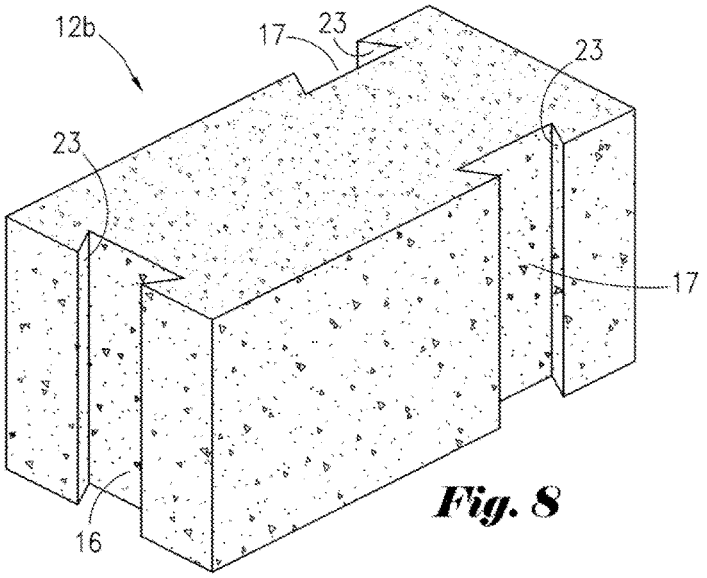
FIG. 8 is an isometric view of another alternate embodiment of a corner block configured as a T-junction block of the interlocking construction block assembly of the present invention.
Figure 9:
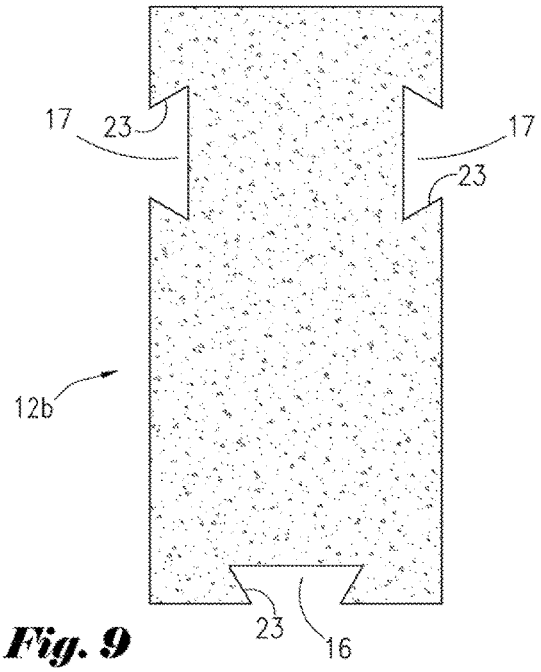
FIG. 9 is a top view of the T-junction block shown in FIG. 8.
Figure 10:
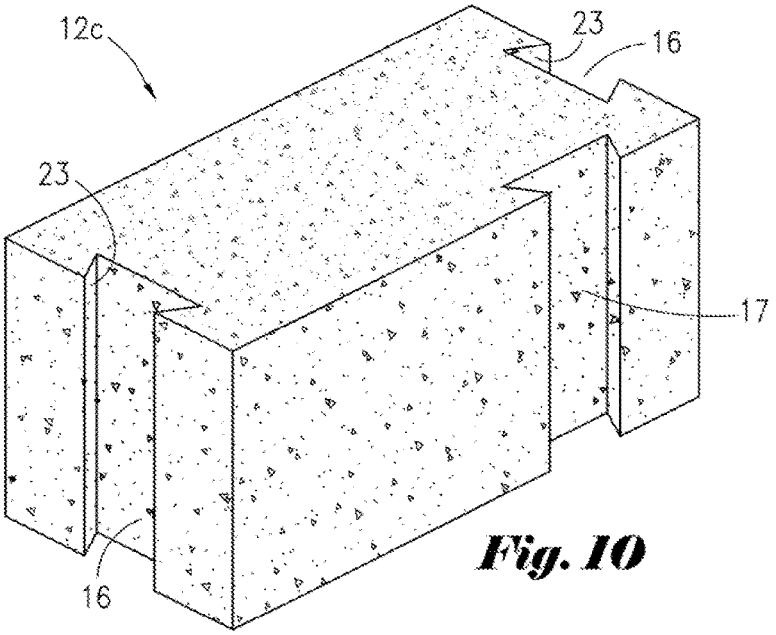
FIG. 10 is an isometric view of still another alternate embodiment of a corner block configured as a T-junction block of the interlocking construction block assembly of the present invention.
Figure 11:
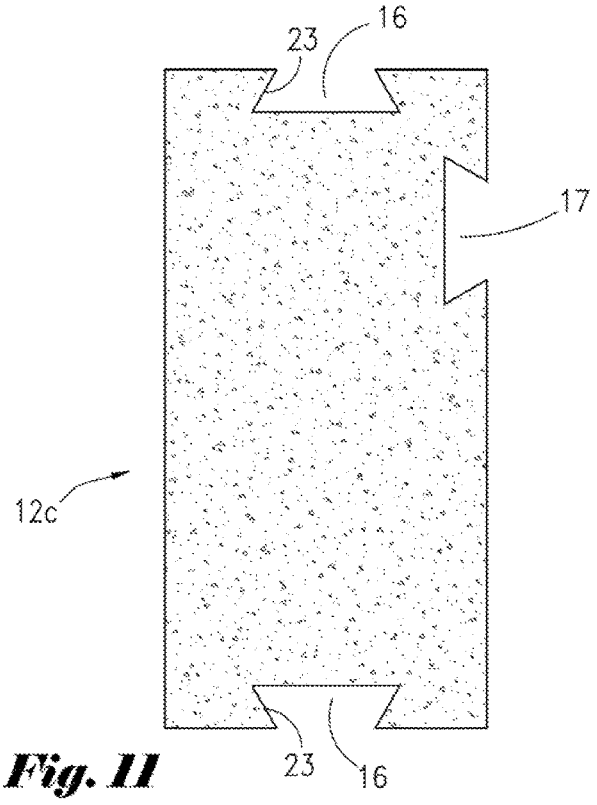
FIG. 11 is a top view of the T-junction block shown in FIG. 10.

Referring now to FIGS. 6 & 7, junction block 12*a* is shown as an alternate embodiment of corner block 12 for creation of intersecting perpendicular walls 4,5. Junction block 12*a* is composed of two terminal ends 1 and elongate sides 2 having terminal channels 16 on terminal ends 1 and lateral channels 17 positioned off center opposite to each other on elongate sides 2. Junction block 12*a*, with terminal channels 16 and lateral channels 17, is designed to provide a means of interconnecting intersecting and perpendicularly progressing walls 4, 5.

Terminal channels 16 and lateral channels 17 when placed near the terminal channel 16 of another block 10 on the same horizontal row creates slot 21 to allow for passage of peg 14 to affix and cause self-alignment between junction block 12*a* and an adjacent block 10. Insertion of peg 14 into slots 21 formed by the intersection of either the terminal channels 16 of junction block 12*a* and a linear block 11 or the lateral channel 17 with the terminal channel 16 of a linear block 11, as desired to continue form perpendicular junction 7 and continue the formation of intersecting walls 4, 5, will maintain the intersection in place even when exposed to vibration or shifting of the ground by nearby movement.

Similarly, when forming a perpendicular junction 7 by placing blocks 10 in a staggered arrangement, slot 21, formed by the abutting of channels 16, 17 of junction block 12*a* and linear blocks 11, may be placed vertically adjacent to channels 18 of a vertically adjacent linear block 11. The uniform design of channel 18 and slots 21 allows for passage of peg 14 through channel 18 and slot 21 to affix and self-align the junction block 12*a* in place with the vertically adjacent linear block 11.

Referring now to FIGS. 8-11, T-junction blocks 12*b* & 12*c* are shown as an alternate embodiment of corner block 12 for creation of a T-junction between two intersecting perpendicular walls 4, 5. T-junction block 12*b* is composed of two terminal ends 1 and elongate sides 2 having a single terminal channel 16 on a terminal end 1 and two lateral channels 17 positioned off center opposite to each other on elongate sides 2 proximate to the opposing terminal end 1. T-junction block 12*c* is composed of two terminal ends 1 and elongate sides 2 having two terminal channels 16 on terminal ends 1 and a single lateral channel 17 positioned off center on elongate side 2. T-junction blocks 12*b*, 12*c*, with alternatively oriented single terminal channel 16 and two lateral channels 17 or single lateral channel 17 and two terminal channels 16, are designed to provide a means of interconnecting intersecting and perpendicularly progressing walls 4, 5, such as for creation of perpendicular wall junction 7.

Terminal and lateral channels 16, 17 when placed near the terminal channel 16 of another block 10 on the same horizontal row will create hourglass shaped slot 21 to allow for passage of peg 14 to affix and cause self-alignment between T-junction blocks 12*b*, 12*c* and an adjacent block 10. Insertion of peg 14 into slots 21 formed by the intersection of either the terminal channels 16 of T-junction blocks 12*b*, 12*c* and a linear block 11 or the lateral channels 17 of T-junction blocks 12*b*, 12*c* with the terminal channels 16 of a linear block 11, as desired to adjoin intersecting walls 4, 5, will maintain the intersection in place even when exposed to vibration or shifting of the ground by nearby movement.

Similarly, when forming a perpendicular junction 7 by placing blocks 10 in a staggered arrangement, slot 21, formed by the abutting of channels 16, 17 of T-junction blocks 12*b*, 12*c* and linear blocks 11, may be placed vertically adjacent to channels 18 of a vertically adjacent linear block 11. The uniform design of channel 18 and slots 21 allows for passage of peg 14 through channel 18 and slot 21 to affix and self-align the T-junction blocks 12*b*, 12*c* in place with the vertically adjacent linear block 11.

Figure 12:
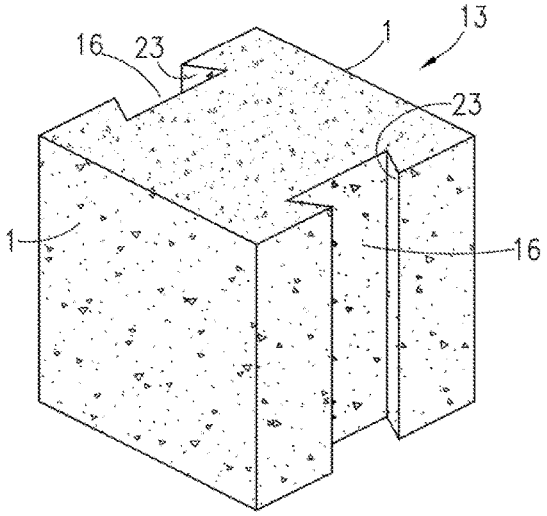
FIG. 12 is an isometric view of the half block of the interlocking construction block assembly of the present invention.
Figure 13:
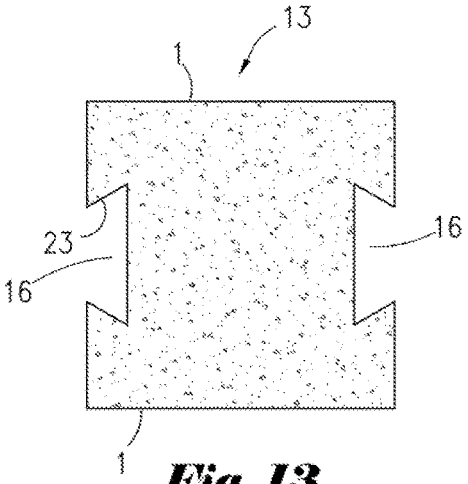
FIG. 13 is a top view of the half block shown in FIG. 12.

Referring to FIGS. 12-17, a cube shaped half block 13 is described having four terminal ends 1. Half blocks 13 and 13*a-c* are a cube shape in order to be utilized for maintaining the proper progression of formation of outer walls 4 and inner walls 5. As best seen in FIGS. 12 & 13, a linear embodiment of half block 13 is described composed of two terminal channels 16 positioned upon opposing terminal ends 1. After a corner block 12, junction block 12*a*, or T-junction 12*b* or 12*c* have been utilized to create a perpendicular junction 7 between adjoining walls 4, 5 by insertion of blocks 12 or blocks 12*a-c* perpendicular to the linear axes of walls 4, 5, the shorter terminal ends 1 of blocks 12 or 12*a-c* will offset the advancement of walls 4, 5, wherein the parallel or staggered progressions of walls 4, 5 will be effected. In such an event, half block 13 may be inserted to restore the parallel or staggered pacing of linear blocks 11 placement in the formation of outer walls 4 or inner walls 5.

Figure 14:
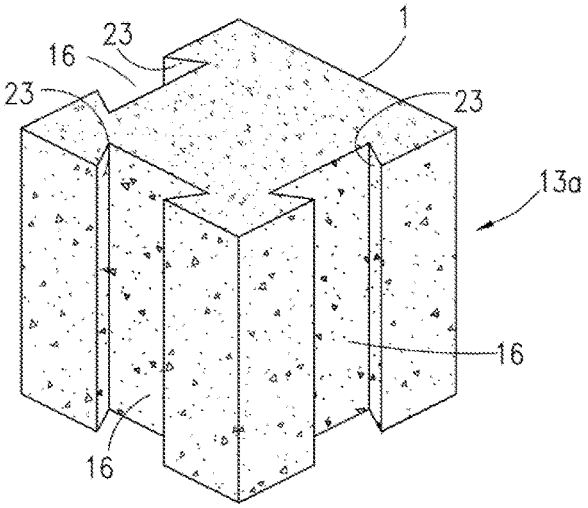
FIG. 14 is an isometric view of an alternate embodiment of the half block configured as a T-junction half block of the interlocking construction block assembly of the present invention.
Figure 15:
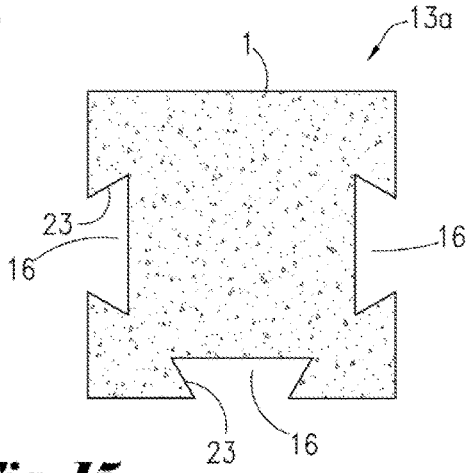
FIG. 15 is a top view of the T-junction half block shown in FIG. 14.
Figure 16:
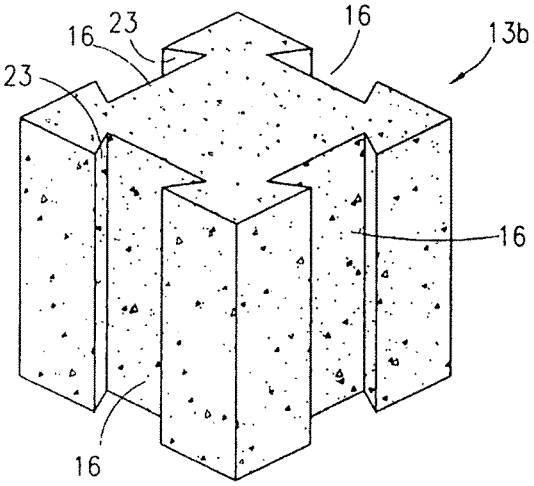
FIG. 16 is an isometric view of an alternate embodiment of a the half block configured as a junction half block of the interlocking construction block assembly of the present invention.
Figure 17:
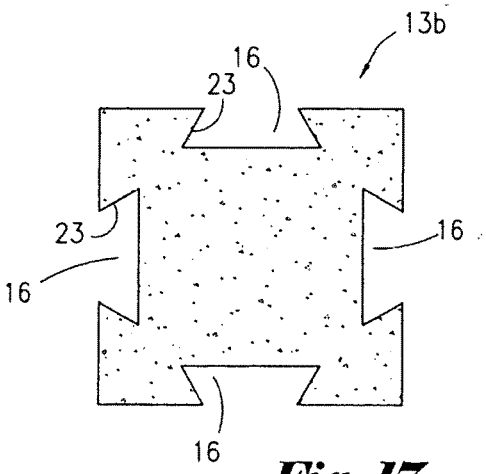
FIG. 17 is a top view of junction half block shown in FIG. 16.
Figure 18:
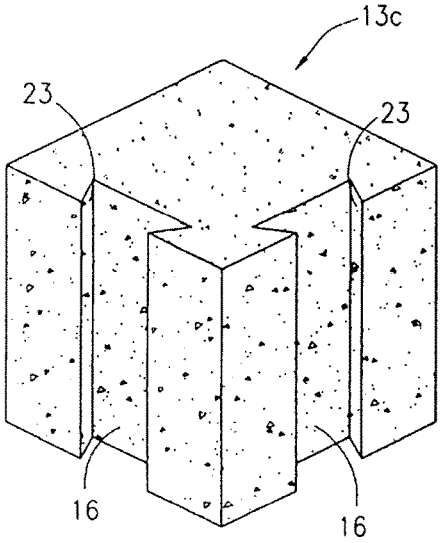
FIG. 18 is an isometric view of still another alternate embodiment of the half block configured as a corner half block of the interlocking construction block assembly of the present invention.
Figure 19:
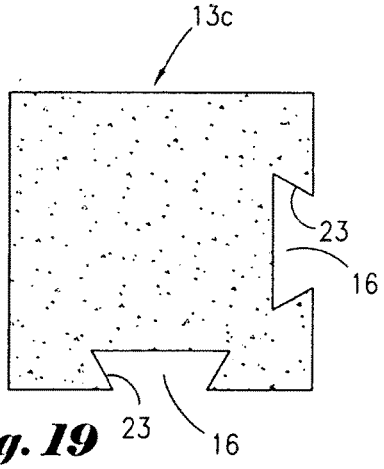
FIG. 19 is a top view of the corner half block shown in FIG. 18.

Blocks 13, 13*a-c* are employed to facilitate proper progression and junctioning of walls 4, 5 without the necessity of cutting or reorientation of blocks 10. Channels 16 run through block 13 along the same plane to allow passages to be created between horizontal and vertically adjacent blocks 10. As best seen in FIGS. 14-19, alternative embodiments of half block 13 are described. As shown in FIGS. 14 & 15, a T-junction half block 13*a* is described having three terminal channels 16 for formation of a perpendicular junction 7 between two perpendicular walls 4, 5. As shown in FIGS. 16 & 17, a junction half block 13*b* is shown having four terminal channels 16 for creation of a perpendicular junction 7 between intersecting walls 4, 5. As shown in FIGS. 18 & 19, a corner half block is described having two terminal channels 16 positioned upon adjacent terminal ends 1 in order to provide a means of creating corner 6.

Figure 20:
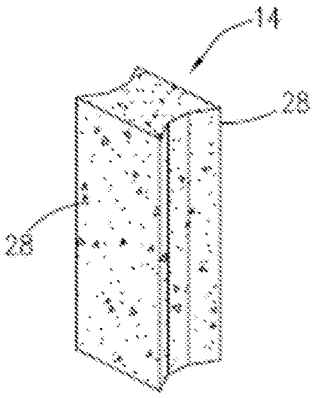
FIG. 20 is an isometric view of a polygonal shaped peg configured as a hourglass shaped peg for aligning and connecting the interlocking construction blocks.
Figure 21:
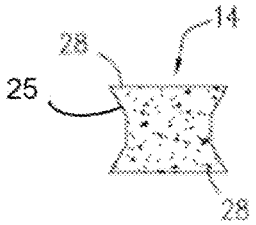
FIG. 21 is a top view of the peg shown in FIG. 20.

Referring now to FIGS. 20 & 21, a polygonal shaped peg, shown as hourglass shaped peg 14, is disclosed for use in self-aligning and affixing in place horizontally and vertically adjacent blocks 10. Peg 14 is defined by outwardly projecting edges 28 wherein faces 25 slant inward to intersect each other towards the center of peg 14. Peg 14 may be of any suitable size for fitting within channels 18 and the junctions of two adjacent channels 16, 17 forming slot 21. Further, peg 14 can be of any suitable desired length to extend through channels 18 and slots 21 between at least two horizontal rows of vertically adjacent blocks 10 in order to facilitate a fixed hold along several rows of end-to-end segments of blocks 10 stacked vertically.

Figure 22:
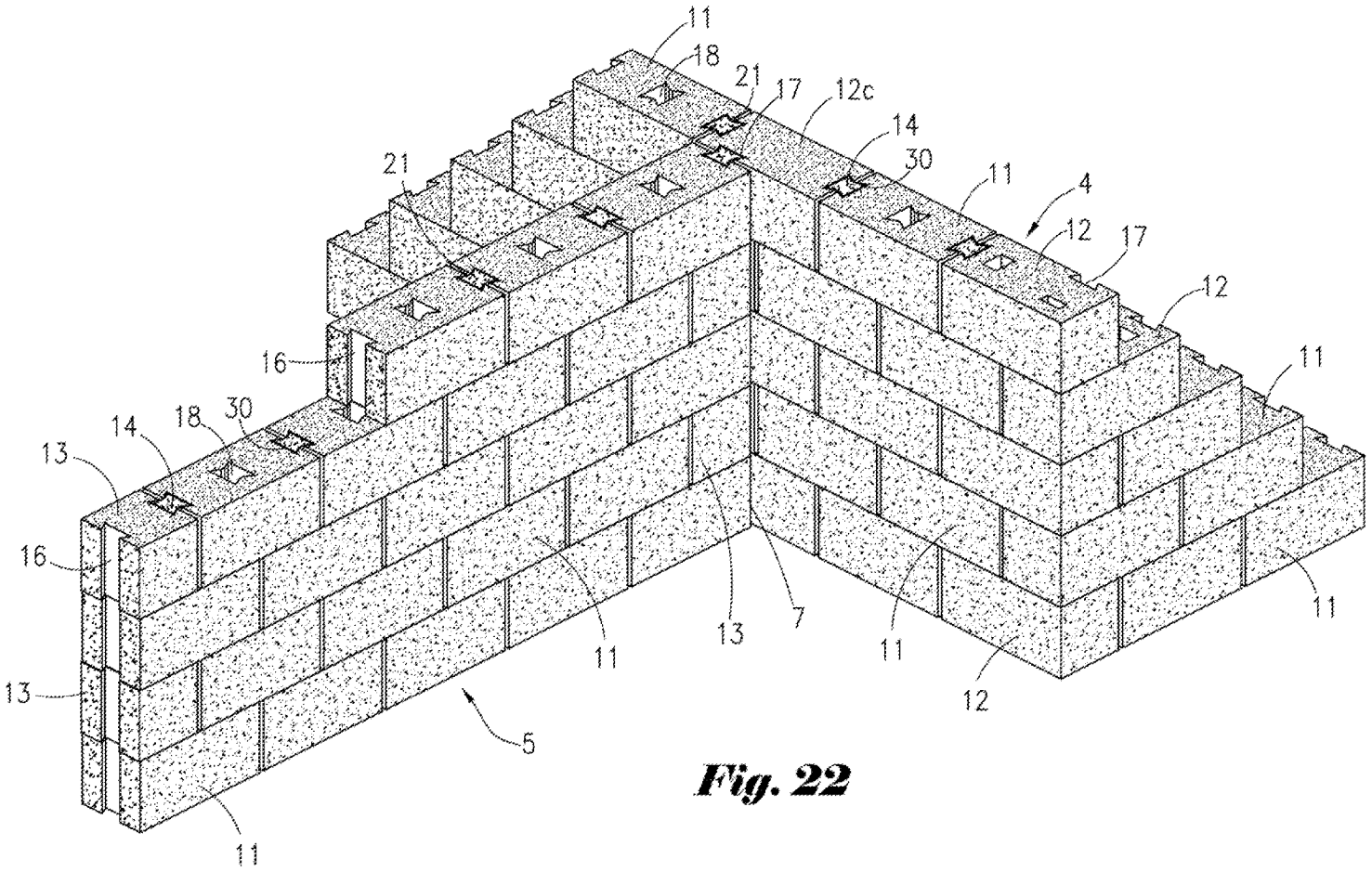
FIG. 22 is an isometric view of perpendicular walls formed by the assembly of a series of interlocking construction blocks.

As best seen in FIG. 22, in forming a wall 4, 5 in staggered columns of stacked blocks 10, channels 18 of linear blocks 11 will be placed into a vertically adjacent orientation with the slots 21. Likewise, the slots 21, formed by abutment of two terminal channels 16 of linear blocks 11, will be placed into a vertically adjacent orientation with the channels 18 of vertically adjacent staggered linear blocks 11. When peg 14 is inserted through channel 18 in alignment with slots 21, the wedge shaped inward projection 20 and faces 19 forming the channels 18 will slidably mate with edges 28 and faces 25 of peg 14, wherein the abutting edges 22 and slanting faces 23 forming the polygonal shape of slots 21 will slidably mate with edges 28 and faces 25 of peg 14.

Once peg 14 has been inserted through channel 18 and slots 21, the frictional forces between the abutment of faces 19 and faces 25 and faces 23 and faces 25 will force the adjacent blocks 10 into alignment and grippingly hold the adjacent blocks 10 in staggered alignment and resist external forces which would otherwise cause the shifting of blocks 10 out of alignment. In the event of a misaligned placement of vertically adjacent blocks 10 wherein channel 18 or slots 21 of the vertically adjacent blocks 10 do not properly align, the insertion of peg 14 will force the vertically adjacent blocks 10 into alignment by sliding faces 19, 23 of channels 18 and slots 21, respectively, against the faces 25 of peg 14 which will in turn push and drive the channels 18 and slots 21 for proper alignment.

Alternatively, in forming a wall 4, 5 in parallel columns of stacked blocks 10, during linear formation of walls 4, 5, the channel 18 or slot 21 of the top block 10 will be placed into a vertically adjacent orientation with the channel 18 or slot 21 of the series vertically adjacent blocks 10 below it. When peg 14 is inserted through vertically adjacent channels 18, the wedge shaped inward projection 20 and faces 19 forming the polygonal shape of channels 18 will slidably mate with edges 28 and faces 25 of peg 14. When peg 14 is inserted through vertically adjacent slots 21, the abutting edges 22 and slanting faces 23 of the horizontally adjacent blocks 10 forming slots 21 will slidably mate with edges 28 and faces 25 of peg 14.

Once peg 14 has been inserted through channels 18 or slots 21, the frictional forces between the abutment of faces 19 of channel 18 and faces 25 of peg 14 or faces 23 of slot 21 and faces 25 of peg 14 will force the adjacent blocks 10 into alignment and grippingly hold the vertically adjacent blocks 10 in a parallel column alignment and resist external forces which would otherwise cause the shifting of blocks 10 out of alignment. In the event of a misaligned placement of vertically adjacent blocks 10, the insertion of peg 14 will force the vertically adjacent blocks into alignment by sliding faces 19 of channel 18 against the faces 25 of peg 14 and push and drive the channels 18 or slots 21 into proper alignment with each other.

During linear formation of an outer wall 4, in order to facilitate internal wall 5 formation wherein the outer wall 4 may continue its linear progression thereafter, a T-junction block 12*b* having two lateral channels 17, T-junction block 12*c* having two terminal channels 16, or a T-junction half block 13*a* having three terminal channels 17 will be positioned perpendicular to the axis created by the linear progression of outer wall 4. In forming an internal wall 5 with T-junction block 12*b*, terminal end 1 having terminal channel 16 will be oriented to project the terminal channel 16 of T-junction block 12*b* inward from outer wall 4, wherein the lateral channels 17 of T-junction block 12*b* will oriented to linearly align with the terminal channels 16 of the linear block arrangement of outer wall 4. In forming an internal wall 5 with T-junction block 12*c*, elongate side 2 having lateral channel 17 will be oriented to project lateral channel 17 of T-junction block 12*c* inward from outer wall 4, wherein the terminal channels 16 of T-junction block 12*c* will be oriented to linearly align with the terminal channels 16 of the linear block arrangement of outer wall 4. In forming an internal wall 5 with T-junction half block 13*a*, the central channel 16 of the three adjacent channels 16 will be oriented to project the central channel 16 inward from outer wall 4, wherein the outside terminal channels 16 of T-junction half block 13*a* will be oriented to linearly align with the terminal channels 16 of the linear block arrangement of outer wall 4.

After insertion of T-junction blocks 12*b*, 12*c*, or half block 13*a*, channels 16, 17 will project inward at a substantially ninety-degree angle (90°) to the linear axis of outer wall 4, wherein additional linear blocks 11 or linear half blocks 13 will begin the creation of an inner wall 5. Furthermore, use of T-junction blocks 12*b*, 12*c*, or half blocks 13*a* in internal wall 5 formation removes the need to spread mortar along the inner portion of outer wall 4 which thus prevents internal wall 5 alignment problems due to mortar deflection.

When an internal wall 5 is created by use of T-junction blocks 12*b*, 12*c*, or half blocks 13*a*, the staggered progression of outer wall 4 may be effected. Linear half block 13 may be used to correct the offset created by the insertion of the shorter length of the terminal end 1 of blocks T-junction blocks 12*b*, 12*c*, or half block 13*a* into the progression of outer wall 4 and allow fbr continuation of the staggered or parallel column end-to-end progression of the inner 5 and outer walls 4 so as to prevent issues with formation of subsequent outer corners 6 and perpendicular junctions 7. Thereafter, walls 4, 5 may be continued by addition of linear blocks 11 and linear half blocks 13.

After formation of an internal wall 5, additional internal walls 5 may be created by adding additional corner blocks 12, junction blocks 12*a*, or T-junction blocks 12*b* or 12*c*. Linear blocks 11 and half blocks 13 may then be added as desired to create rooms and hallways within a structure by creation of additional internal walls 5.

As best seen in FIG. 1, an outer wall corner 6 may be created by placement of corner blocks 12, having a single terminal channel 16 and a single lateral channel 17, at a desired position at the end of a length of outer wall 5. As determined by the required placement of corner 6, either terminal channel 16 or lateral channel 17 of corner block 12 will be oriented to place the opposite channel 16, 17 of corner block 12 in the desired ninety-degree (90) direction to place corner block 12 perpendicular to the linear progression of outer wall 4 and form corner 6, wherein placement of additional linear blocks 11 or linear half blocks 13 may begin the creation of a new section of outer wall 5 projecting from corner 6.

Now referring to FIG. 22, the size and shape of channels 16, 17, 18 and peg 14 may be modified so that after insertion of peg 14 into channel 18 or slot 22 a cavity 30 will remain. Cavity 30 may be provided in addition to hollow cells 24 and extended sleeves 26 to afford an additional air pocket for compensation of expansion and contraction of blocks 10 due to changes in temperature or for placement of an additional section of rebar 27 to provide added structural integrity of the wall 4, 5. In conjunction with either the staggered or parallel column placement of blocks 10, a length of rebar 27 can be fed through vertically adjacent cavities 30, hollow cells 24, and extended sleeves 26 along several vertical rows of blocks 10 to grip and hold blocks 10 in place.

Mortar or grout may be spread upon the outer surface between blocks 10 to provide a fixed hold between vertically and horizontally adjacent blocks 10 or to fix rebar 27 in place within cavities 30, hollow cells 24, and extended sleeves 26. Application of mortar or grout upon blocks 10 provides reinforcement to the structural integrity of walls 4, 5 as well as insulation from temperature changes through the small spaces between each horizontal and vertically adjacent block 10. Further, concrete may be poured within the vertically adjacent hollow cells 24, extended sleeves 26, and cavities 30 to form internal concrete pillars and thus produce walls 4, 5 which are capable of withstanding hurricane force winds. The poured concrete will flow into the vertically adjacent cells 24, sleeves 26, and cavities 30 and harden to form a solid concrete pillar within walls 4, 5 which provides a solid central retaining structure capable of withstanding perpendicular gust forces in excess of sixty-four knots or one-hundred eighteen kilometers per hour, seventy-four miles per hour.

Figure 23:
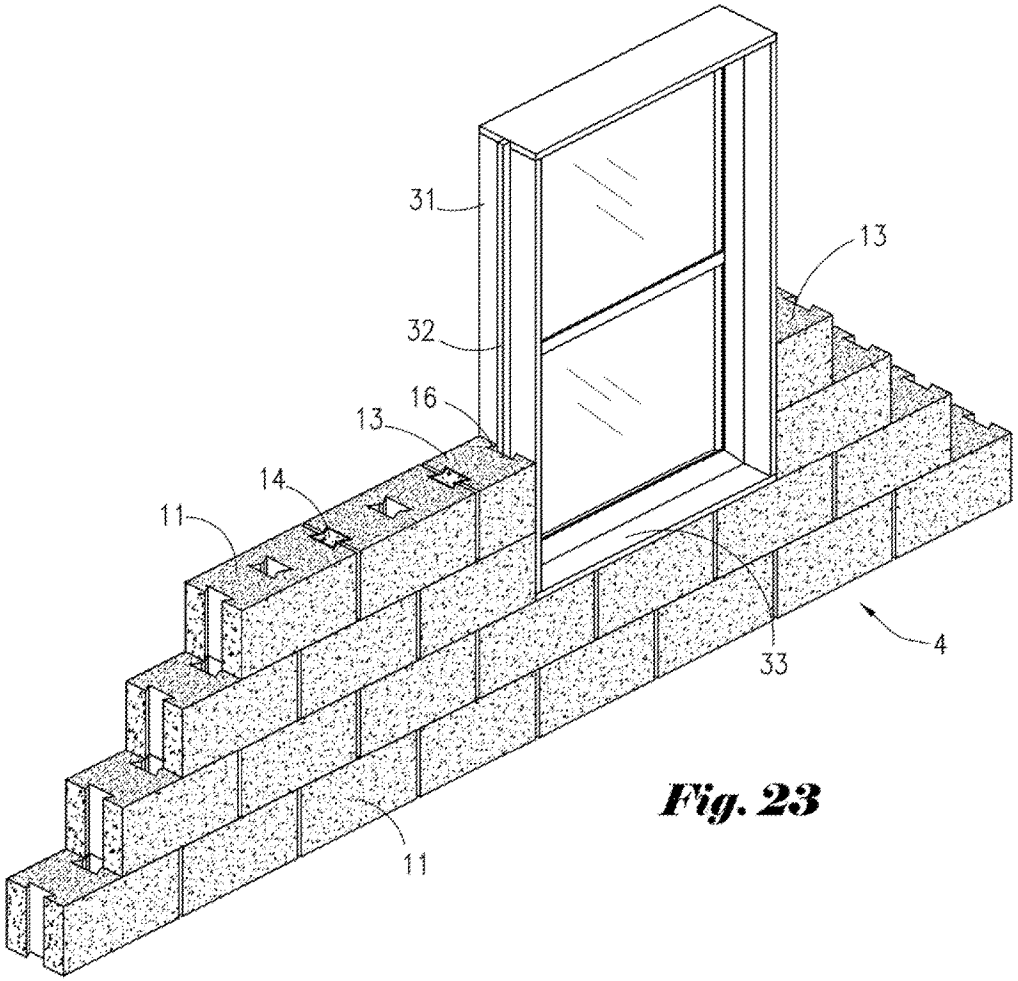
FIG. 23 is an isometric view of a wall formed by the assembly of a series of interlocking construction blocks affixed around the frame of a door or window.

Referring now to FIG. 23, terminal channels 16 of blocks 10 may be placed about the frame 31 of a doorway or window to provide a fixed hold for the frame 31 within walls 4, 5. Projections 32 upon frame 31 may be inserted within terminal channels 16 of the linear 11 or linear half blocks 13 wherein mortar, grout, concrete, or other fixing means may be applied to set frame 31 in place within wall 4, 5. In a staggered end-to-end arrangement of blocks 10, linear half blocks 13 may be used to create a flush vertical row of channels 16 to encompass projection 32 of frame 31. Further, lips 33 at the top and bottom ends of frame 31 may be placed and set with mortar, grout, concrete, or other fixing means upon the linear blocks 11 and linear half blocks 13 above and below frame 31 to provide a fixed and insulated hold for frame 31 within walls 4, 5.

In their preferred embodiment, blocks 10 are envisioned to be composed of cast concrete, such as Portland cement and aggregate, wherein high-density blocks may be formed of sand and fine gravel, lower density blocks may use industrial wastes such as an aggregate, and lightweight blocks may be produced using aerated concrete. Though, it should be understood that blocks 10 may be composed of whichever material suitable to those skilled in the art including, but not limited to, polymers, wood, ceramic, or metal.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments as illustrated herein, but is limited only by the following claims.

I claim:

1. A self-aligning wall construction, comprising:

a. a plurality of blocks comprising:

i. a plurality of linear rectangular blocks having two elongate ends and two terminal ends, each said linear blocks having, an internal polygonal shaped channel located between said two elongate ends and two terminal ends, each said linear block having a terminal polygonal shaped channel positioned upon each said terminal end of said linear block, wherein each said terminal polygonal channel is positioned equidistant upon each said terminal end, said terminal polygonal channels and said internal polygonal shaped channel traversing through each said linear block, along the same axial plane;

ii. a plurality of corner rectangular blocks having two elongate ends and two terminal ends, each said corner block having at least one corner block terminal polygonal shaped channel positioned upon one of said terminal ends of each said corner block, wherein said at least one corner block terminal polygonal channel is positioned equidistant upon said terminal end, each said corner block having at least one lateral polygonal shaped channel positioned upon one of said elongate ends of each said corner block, said at least one lateral polygonal channel positioned off-center upon each said elongate end, said corner block terminal polygonal channel and said lateral polygonal channel traversing through each said corner block along the same axial plane;

iii. a plurality of cubic shaped half blocks having four terminal ends, said half block having at least two terminal polygonal channels traversing through each said half block along the same axial plane; and iv. wherein a polygonal shaped slot is formed by orientation of said polygonal shaped channels of said plurality of blocks in an end-to-end abutting relationship;

b. a plurality of elongate pegs having outwardly projecting edges and slanted inward faces forming a polygonal shape, wherein said edges and faces of each said peg are formed as to allow each said peg to be slidably inserted within said polygonal shaped slots formed by abutting polygonal channels of said linear, corner, and half blocks and said internal polygonal shaped channels of each said linear blocks, wherein insertion of said peg into said internal polygonal shaped channels and said polygonal shaped slots couples said linear, corner, and half blocks together;

c. wherein a linear wall is formed by a plurality of said linear blocks and said half blocks arranged to form a horizontal row by placement of said terminal polygonal channels of each said linear and half blocks in an end-to-end abutting relationship, wherein insertion of said polygonal shaped peg into said polygonal shaped slots formed by said terminal polygonal channels of adjacent said linear blocks will affix said linear blocks together, wherein insertion of said polygonal shaped pegs into and through said internal polygonal shaped channels and said polygonal shaped slots of a first said row of said linear blocks and through said internal polygonal shaped channels and said polygonal shaped slots of a second said row of said linear blocks will affix said first row of said linear blocks to said second row of said linear blocks vertically adjacent to said first row of said linear blocks;

d. wherein a corner or perpendicular wall junction is formed in said linear wall by placement of a column of said corner blocks with said lateral or corner block terminal polygonal channels of said corner blocks placed in an end-to-end abutting relationship with said terminal polygonal channels of said linear blocks, wherein insertion of said polygonal shaped peg into said polygonal shaped slots formed by said corner block terminal polygonal channels or said lateral polygonal channels of said corner blocks and said terminal polygonal channels of an adjacent said linear block, will affix said linear block and said corner block together, wherein said corner or wall junction will allow for perpendicular wall formation;

e. wherein said half blocks is configured to be inserted to correct any offset in the progression of said walls, wherein said terminal polygonal channels of said half block will be placed in an end-to-end abutting relationship with said terminal polygonal channels of said linear blocks and said corner block terminal polygonal channels or said lateral polygonal channels of said corner blocks, wherein insertion of said polygonal shaped pegs into said polygonal shaped slots formed by said terminal polygonal channels of said linear block or said corner block terminal polygonal channel or said lateral polygonal channel of said corner blocks with said terminal polygonal channels of said half block will affix said linear blocks or said corner blocks with said half block.

2. The self-aligning wall construction of claim 1, further comprising each said corner blocks baying hollow cells and sleeves traversing said blocks along the same plane as said terminal and lateral polygonal channels.

3. The self-aligning wall construction of claim 2, wherein said terminal and lateral polygonal shaped channels and polygonal shaped slots of said plurality of blocks are formed as to create a cavity within said internal polygonal shaped channels and polygonal shaped slots after insertion of said peg.

4. The self-aligning wall construction of claim 3, wherein said corner or perpendicular wall junction is configured to be formed by insertion of said half blocks.

5. The self-aligning wall construction of claim 4, wherein said plurality of blocks are fixed in engagement with adjacent said blocks by application of mortar, grout, or other gap sealant conventional in the art.

6. The self-aligning will construction of claim 5, further comprising a frame having a projection and lips for fitted engagement with said plurality of blocks, wherein said projection of said frame extends into said terminal or lateral polygonal channels of said plurality of blocks and said lips slidably mount said elongate ends of said plurality of blocks, wherein said projection and said lips of said frame are fixed in engagement with adjacent said blocks by application of mortar, grout, or other gap sealant conventional in the art.

7. The self-aligning wall construction of claim 5, further comprising a. reinforcing internal pillar formed by pouring concrete within said cavities, hollow cells, and elongate sleeves of said plurality of blocks.

8. The self-aligning wall construction of claim 5, further comprising a length of rebar fixedly placed into and through said rows of adjoined plurality of blocks, wherein said rebar will pass through said cavities, hollow cells, and sleeves, wherein said length of rebar are fixed in engagement within said cavities, hollow cells, and sleeves of said plurality of blocks by application of mortar, grout, or other gap sealant conventional in the art.

9. The self-aligning wall construction of claim 5, wherein each of said plurality of blocks forming said rows are arranged in a staggered pattern to vertically adjacent said rows of said plurality of blocks, wherein said internal polygonal shaped channels of said linear blocks will vertically align with said polygonal shaped slots formed by end-to-end abutting said polygonal channels of said plurality of blocks, wherein insertion of said peg will pass vertically through said internal polygonal shaped channels and said polygonal shaped slots to vertically align and fix said rows.

10. The self-aligning wall construction of claim 5, wherein each of said plurality of blocks forming said rows are arranged in parallel columns to each vertically adjacent said block, wherein said internal polygonal shaped channels of said linear blocks will vertically align with said internal polygonal shaped channels of said vertically adjacent linear blocks and wherein said polygonal shaped slots formed by end-to-end abutting said polygonal channels of said plurality of blocks will vertically align with said polygonal shaped slots formed by end-to-end abutting of said polygonal channels of said blocks in the vertically adjacent said rows, wherein insertion of said peg will pass vertically through said internal polygonal shaped channels and said polygonal shaped slots to vertically align and fix said rows.

* * * * *